US006635612B1

(12) United States Patent
Norman et al.

(10) Patent No.: US 6,635,612 B1
(45) **Date of Patent: *Oct. 21, 2003**

(54) PROCESS FOR DELIVERING CHELANT AGGLOMERATE INTO DETERGENT COMPOSITION FOR IMPROVING ITS STORAGE STABILITY, FLOWABILITY AND SCOOPABILITY

(75) Inventors: Wendell I. Norman, Cincinnati, OH (US); Dennis Lee Perkins, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/806,880

(22) PCT Filed: Oct. 1, 1999

(86) PCT No.: PCT/US99/22922

§ 371 (c)(1),
(2), (4) Date: Apr. 5, 2001

(87) PCT Pub. No.: WO00/20550

PCT Pub. Date: Apr. 13, 2000

(51) Int. Cl.[7] ..... C11D 11/00; C11D 7/32

(52) U.S. Cl. ..... 510/444; 510/361; 510/480; 510/531; 510/533

(58) Field of Search ..... 510/444, 480, 510/531, 533, 361

(56) References Cited

U.S. PATENT DOCUMENTS

| | | | | | |
|---|---|---|---|---|---|
| 3,546,123 | A | | 12/1970 | Stahlheber et al. | 510/349 |
| 4,040,988 | A | * | 8/1977 | Benson et al. | 510/438 |
| 4,231,887 | A | * | 11/1980 | Denny et al. | 510/532 |
| 4,430,243 | A | * | 2/1984 | Bragg | 510/311 |
| 4,668,420 | A | * | 5/1987 | Diehl et al. | 510/471 |
| 5,292,446 | A | * | 3/1994 | Painter et al. | 510/230 |
| 5,366,652 | A | * | 11/1994 | Capeci et al. | 510/444 |
| 5,460,926 | A | * | 10/1995 | Komatsu et al. | 430/401 |
| 5,486,303 | A | * | 1/1996 | Capeci et al. | 510/444 |
| 5,635,467 | A | * | 6/1997 | Staley | 510/349 |
| 5,712,242 | A | * | 1/1998 | Aouad et al. | 510/444 |
| 5,744,639 | A | * | 4/1998 | Verrett | 562/572 |
| 5,800,755 | A | * | 9/1998 | Withenshaw et al. | 264/117 |
| 5,877,140 | A | * | 3/1999 | Hardy et al. | 510/351 |
| 5,998,663 | A | * | 12/1999 | Verrett | 562/572 |
| 6,296,670 | B1 | * | 10/2001 | Rusche et al. | 8/137 |
| 6,479,455 | B1 | * | 11/2002 | Cruse et al. | 510/532 |

FOREIGN PATENT DOCUMENTS

| | | |
|---|---|---|
| DE | 31 20 744 A1 | 12/1982 |
| EP | 0 419 036 A2 | 8/1990 |
| EP | 0 796 911 A1 | 9/1997 |
| EP | 0 846 758 A2 | 6/1998 |
| JP | 59157194 A | 9/1984 |
| WO | WO 92/09680 | 6/1992 |
| WO | WO 97/09415 | 3/1997 |

* cited by examiner

*Primary Examiner*—Lorna M. Douyon
(74) *Attorney, Agent, or Firm*—Brahm J. Corstanje; Brian M. Bolam; Kim William Zerby

(57) ABSTRACT

The present invention provides a process for preparation of a chelant composition by a non-spray-drying process, a process for improving one or more of flowability and scoopability of a laundry detergent composition, and a chelant agglomerate useful as an ad-mix in a particulate laundry detergent. In one aspect of the present invention, the process for preparation of a chelant composition by a non-spray-drying process includes the steps of admixing a transition metal chelant and an inorganic compound to form a mixture, aglomerating the mixture in an aqueous medium to form a chelant agglomerate and drying the chelant agglomerate.

22 Claims, No Drawings

PROCESS FOR DELIVERING CHELANT AGGLOMERATE INTO DETERGENT COMPOSITION FOR IMPROVING ITS STORAGE STABILITY, FLOWABILITY AND SCOOPABILITY

TECHNICAL FIELD

The present invention relates to a laundry detergent compositions and more particularly, to a process for improving storage stability and scoopability of laundry detergent compositions by incorporation of useful levels of a concentrated chelant agglomerate into a laundry detergent composition.

BACKGROUND OF THE INVENTION

It has been extremely desirable to have a process for increasing the storage stability and scoopability of detergent compositions. This is a characteristic that most consumers are very desirous of because consumers do not want to have to deal with detergent compositions that "clump" together after the detergent box has been laid open for an extended period of time due to the inadvertent absorption of moisture.

It has been recognized that the incorporation of a transition metal chelant into the base granules of the laundry detergent composition causes the promotion of interlocking crystalline needle growth which is suspected to detrimentally affect the resultant particulate laundry detergent composition's flowability and scoopability properties. Thus it has been recognized by the inventors of this particular invention that it is extremely advantageous to devise a method of separating the transition metal chelant from the base granule of the laundry detergent composition, so that any useful level of the transition metal chelant may be incorporated in the overall laundry detergent composition without adversely affecting its flowability and scoopability properties. It has thus been extremely desirable to have a process or a method whereby any useful level of a chelant agglomerate can be ad-mixed into a laundry detergent composition such that the chelant agglomerate desirably improves the solubility and storage stability of the resultant ad-mixed detergent composition formulation and at the very least, does not detrimentally affect the laundry detergent composition's flowability and scoopability characteristics. The present invention overcomes the problems, as set forth above.

BACKGROUND ART

U.S. Pat. No. 5,108,646 discloses a process for making detergent builder agglomerates by mixing a detergent builder with a selected binder to form free flowing agglomerates.

International Publication Number WO 97/09415 disloses a non-spray-dried particulate detergent composition prepared by mixing and granulating liquid and solid ingredients in a high-speed mixer/granulator, containing a builder polymer and/or a soil-release polymer, wherein the polymer is incorporated during the mixing and granulating process in the form of a non-aqueous premix with a non-aqueous diluent.

SUMMARY OF THE INVENTION

The invention meets the needs above by providing a process for preparation of a chelant composition by a non-spray-drying process, a process for improving one or more of storage stability, flowability and scoopability of a laundry detergent composition, and a chelant agglomerate useful as an ad-mix in a particulate laundry detergent.

In one aspect of the present invention, a process for preparation of a chelant composition by a non-spray-drying process includes the steps of admixing a transition metal chelant and an inorganic compound to form a mixture, agglomerating the mixture in an aqueous medium to form a chelant agglomerate and drying the chelant agglomerate.

In another aspect of the present invention, a process for improving one or more of storage stability, flowability and scoopability of a laundry detergent composition includes the steps of providing a chelant composition prepared by a non-spray-drying process and incorporating the chelant composition into a particulate laundry detergent material in a weight ratio in a range of from about 0.05:99.95 to about 2:98, chelant composition to particulate laundry detergent material. The non-spray-drying process includes the steps of admixing a transition metal chelant and an inorganic compound to form a mixture, agglomerating the mixture in an aqueous medium to form a chelant agglomerate, and drying the chelant agglomerate.

In yet another aspect of the present invention, a chelant agglomerate useful as an ad-mix in a particulate laundry detergent is disclosed. The chelant agglomerate has a composition including a transition metal chelant, an inorganic compound and water. The chelant agglomerate is formed by admixing the transition metal chelant and the inorganic compound to form a mixture, agglomerating the mixture in the water to form the chelant agglomerate, and drying the chelant agglomerate.

These and other objects, features and attendant advantages of the present invention will become apparent to those skilled in the art from a reading of the following detailed description of the preferred embodiment and the appended claims.

DETAILED DESCRIPTION OF THE INVENTION

In the preferred embodiment of the present invention, the process for preparation of a chelant composition by a non-spray-drying process includes the steps of admixing a transition metal chelant and an inorganic compound to form a mixture, agglomerating the mixture in an aqueous medium to form a chelant agglomerate, and drying the chelant agglomerate. In the preferred embodiment, the transition metal chelant is sodium ditriaminepentaacetate and the inorganic compound is selected from the group consisting of sulfates, carbonates, silicates, aluminosilicates and mixtures thereof. Desirably, the inorganic compound is an aluminosilicate material and preferably, the inorganic compound is an aluminosilicate ion exchange material of the formula, $M^n{}_m[(AlO2)_m(SiO_z)_y].xH_2O$ where n is the valence of the cation M, x is the number of water molecules per unit cell, m and y are the total number of tetrahedra per unit cell, and y/m is 1 to 100, and wherein M is selected from the group consisting of sodium, potassium, magnesium, and calcium. Most preferably, the inorganic compound is zeolite.

In the preferred embodiment, the step of admixing includes mixing and granulating the transition metal chelant and the inorganic compound in one or more of a high-speed mixer and granulator, desirably in a weight ratio in a range of from about 10:90 to about 80:20 respectively, preferably in a weight ratio in a range of from about 15:85 to about 60:40 respectively and most preferably in a weight ratio in a range of from about 25:75 to about 35:65 respectively In the preferred embodiment, the step of agglomerating includes forming a chelant-inorganic compound pre-mix with water before agglomerating, desirably in a weight ratio in a range of from about 10:90 to about 80:20 respectively, preferably in a weight ratio in a range of from about 15:85 to about 60:40 respectively and most preferably in a weight ratio in a range of from about 25:75 to about 35:65 respectively.

In another preferred embodiment of the present invention, a process for improving storage stability and scoopability of a laundry detergent composition is disclosed. In this preferred embodiment of the present invention, the process includes the first step of forming a chelant agglomerate. It has very surprisingly been found that when the chelant particles are separated from the rest of the laundry detergent composition and chelant agglomerates are formed and then the chelant agglomerates are incorporated into a particulate laundry detergent composition, there is a dramatic increase in the resultant laundry detergent composition's storage stability and scoopability when the chelant agglomerate is eventually ad-mixed with the detergent powder in a desired weight ratio in a range of from about 0.05:99.95 to about 2:98, a preferred weight ratio in a range of from about 0.3:99.7 to about 1.5:98.5, and a most preferred weight ratio in a range of from about 0.1:99.9 chelant agglomerate:laundry detergent composition. Thus it has been surprisingly found that by expressly separating the chelant particles from the laundry detergent composition and only incorporating a chelant agglomerate into a laundry detergent composition, the finish product, i.e., the laundry detergent composition, has much improved "lump cake" properties, i.e., that the detergent composition having a chelant, has improved storage stability and scoopability. Without being bound to any specific theory, it is believed that this improvement is achieved as a result of having separated the hygroscopic transition metal chelant from the rest of the "sticky" laundry composition.

For the purposes herein, the term "lump cake" property is meant to include composition storage stability and powder solubility in water. The term "sticky" components is meant to include a mixture of one or more of surfactants, polyethylene glycol, polyacrylates and water. The term "builder" is intended to mean all materials which tend to remove calcium ion from solution, either by ion exchange, complexation, sequestration or precipitation. The term "scoopability" is defined on a scale of 1 to 5, 1 being the least desirable value and 5 being the most desirable value, of the ability or characteristic of a laundry composition to be scooped up in a spoon without exhibiting tackiness or clumpiness.

Chelants

The chelating agents can be selected from the group consisting of amino carboxylates, amino phosphonates, polyfunctionally-substituted aromatic chelating agents, sodium diethylenetriaminepentaacetates and mixtures thereof. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein.

Amino phosphonates are also suitable for use as chelating agents in the compositions of the invention when at lease low levels of total phosphorus are permitted in detergent compositions, and include ethylenediaminetetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

If utilized, these chelating agents will generally comprise from about 0.05% to about 10% by weight of the detergent compositions herein. More preferably, if utilized, the chelating agents will comprise from about 0.05% to about 3.0% by weight of such compositions.

The most preferred transition metal chelant used to carry out the present invention is sodium ditriaminepentaacetate (DTPA). The DTPA is preferably used in a weight ratio of from about 0.1:99.9 to about 1.5:98.5. DTPA agglomerate-:laundry detergent composition and most preferably, in a weight ratio of 0.4:99.6. Preferably the chelant agglomerate consists of DTPA and zeolite in a preferred weight ratio in a range of from about 15:85 to about 25:75, DTPA:zeolite.

Aluminosilicate Material

In the preferred embodiment of the present invention, the structural formula of an aluminosilicate material is based on the crystal unit cell, the smallest unit of structure represented by:

$$M^n{}_m[(AlO2)_m(SiO_2)_y].xH_2O$$

where n is the valence of the cation M, x is the number of water molecules per unit cell, m and y are the total number of tetrahedra per unit cell, and y/m is 1 to 100. Most preferably, y/m is 1 to 5. The cation M can be Group IA and Group IIA elements, such as sodium, potassium, magnesium, and calcium. The preferred aluminosilicate materials are zeolites. The most preferred zeolites are zeolite A, zeolite X, zeolite Y, zeolite P, zeolite MAP and mixtures thereof.

The aluminosilicate ion exchange materials used herein for chelant agglomerates have both a high calcium ion exchange capacity and a high exchange rate. Without intending to be limited by theory, it is believed that such high calcium ion exchange rate and capacity are a function of several interrelated factors which derive from the method by which the aluminosilicate ion exchange material is produced. In that regard, the aluminosilicate ion exchange materials used herein are preferably produced in accordance with Corkill et al, U.S. Pat. No. 4,605,509 (Procter & Gamble), the disclosure of which is incorporated herein by reference.

Preferably, the aluminosilicate ion exchange material is in "sodium" form since the potassium and hydrogen forms of the instant aluminosilicate do not exhibit the as high of an exchange rate and capacity as provided by the sodium form. Additionally, the aluminosilicate ion exchange material preferably is in over dried form so as to facilitate production of crisp chelant agglomerates as described herein. The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning electron microscope (SEM). The preferred particle size diameter of the aluminosilicate is from about 0.1 micron to about 10 microns, more preferably from about 0.5 microns to about 9 microns. Most preferably, the particle size diameter is from about 1 microns to about 8 microns.

In a preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Laundry Detergent Composition

In the preferred embodiment, the laundry detergent composition has a composition including a chelant agglomerate made according to the present invention and incorporated into the laundry detergent composition. The laundry detergent composition also comprises a builder made by agglomeration or spray dried process, sodium carbonate, sodium sulfate, sodium tripolyphosphate, anionic and nonionic surfactants and balance water. Laundry detergent compositions are well known in the art and various examples of various laundry detergent compositions are disclosed, for example in U.S. Pat. No. 5,554,587, issued to Scott W. Capeci, and assigned to The Procter & Gamble Company.

Chelant Agglomerates Made by Agglomeration Process

In the preferred embodiment of the present invention, the chelant agglomerates are made by an agglomeration process.

The Agglomeration Process

The agglomeration process comprises the steps of:

i) admixing one or more ingredients to form a mixture; and ii) agglomerating the mixture to form agglomerated particles or "agglomerates", and iii) drying the agglomerate.

Typically, such an agglomeration process involves mixing the ingredients in one or more agglomerators such as a pan agglomerator, a Z-blade mixer or more preferably in-line mixers, preferably two, such as those manufactured by Schugi (Holland) BV, 29 Chroomstraat 8211 AS, Lelystad, Netherlands, and Gebruder Lodige Maschinenbau GmbH, D-4790 Paderborn 1, Elsenerstrasse 7–9, Postfach 2050, Germany. Preferably a high shear mixer is used, such as a Lödige CB (Trade Name). Most preferably, a high shear mixer is used in combination with a low shear mixer, such as a Lödige CB (Trade Name) and a Lödige K M (Trade name) or Schugi K M (Trade Name). Optionally, only one or more low shear mixer are used. Preferably, the agglomerates are thereafter dried and/or cooled. An excellent description of an agglomeration process is contained in U.S. Pat. No. 5,554,587, issued to Scott W. Capeci, and assigned to The Procter & Gamble Company.

Another agglomeration process involves mixing of various components of the final agglomorate in different stages, using an fluidized bed. For example, a detergent powder can be agglomerated by spraying on of surfactants and optionally a wax, or mixtures thereof, to the acid source in powdered form and other optional ingredients. Then, additional components, including the perborate bleach and optionally the alkali source or part thereof, can be added and agglomerated in one or more stages, thus forming the final agglomerate particle.

The agglomerates may take the form of flakes, prills, marumes, noodles, ribbons, but preferably take the form of granules. A preferred way to process the particles is by agglomerating dry material (e.g. aluminosilicate, carbonate) with high active surfactant pastes and to control the particle size of the resulting agglomerates within specified limits. Typical particle sizes are from 0.10 mm to 5.0 mm in diameter, preferably from 0.25 mm to 3.0 mm in diameter, most preferably from 0.40 mm to 1.00 mm in diameter. Typically, the "agglomerates" have a bulk density desirably of at least 700 g/l and preferably, in a range of from about 700 g/l to about 900 g/l.

Adjunct Detergent Ingredients

The adjunct ingredients include other detergency builders, bleaches, bleach activators, suds boosters or suds suppressers, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and U.S. Pat. No. 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

Surfactants

Anionic Surfactant

The preferred anionic surfactants include $C_{11}$–$C_{18}$ alkyl benzene sulfonates (LAS) and primary, branched-chain and random $C_{10}$–$C_{20}$ alkyl sulfates (AS), the $C_{10}$–$C_{18}$ secondary (2.3)alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10}$–$C_{18}$ glycerol ethers, the $C_{10}$–$C_{18}$ alkyl polyglycosides and their corresponding sulfated polyglycosides, and $C_{12}$–$C_{18}$ alpha-sulfonated fatty acid esters.

Generally speaking, anionic surfactants useful herein are disclosed in U.S. Pat. No. 4,285,841, Barrat et al, issued Aug. 25, 1981, and in U.S. Pat. No. 3,919,678, Laughlin et al. issued December 30, 1975.

Useful anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates, especially those obtained by sulfating the higher alcohols ($C_8$–$C_{18}$ carbon atoms) such as those produced by reducing the glycerides of tallow or coconut oil.

Other anionic surfactants herein are the water-soluble salts of alkyl phenol ethylene oxide ether sulfates containing from about 1 to about 4 units of ethylene oxide per molecule and from about 8 to about 12 carbon atoms in the alkyl group.

Other useful anionic surfactants herein include the water-soluble salts of esters of a-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and b-alkyloxy alkane sulfonates containing from about 1 to 3 carbon atoms in the alkyl group and from about 8 to 20 carbon atoms in the alkane moiety.

Other useful anionic surfactants herein are the alkyl polyethoxylate sulfates of the formula $$RO(C_2H_4O)_xSO_3^-M^+$$

wherein R is an alkyl chain having from about 10 to about 22 carbon atoms, saturated or unsaturated. M is a cation which makes the compound water-soluble, especially an alkali metal, ammonium or substituted ammonium cation, and x averages from about 1 to about 15.

Other alkyl sulfate surfactants are the non-ethoxylated $C_{12-15}$ primary and secondary alkyl sulfates. Under cold water washing conditions, i.e., less than abut 65° F. (18.3° C.), it is preferred that there be a mixture of such ethoxylated and non-ethoxylated alkyl sulfates. Examples of fatty acids include capric, lauric, myristic, palmitic, stearic, arachidic, and behenic acid. Other fatty acids include palmitoleic, oleic, linoleic, linolenic, and ricinoleic acid.

Nonionic Surfactant

Conventional nonionic and amphoteric surfactants include $C_{12}$–$C_{18}$ alkyl ethoxylates (AE) including the so-called narrow peaked alkyl ethoxylates and $C_6$–$C_{12}$ alkyl phenol alkoxylates (especially ethoxylates and mixed ethoxy/propoxy). The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Examples of nonionic surfactants are described in U.S. Pat. No. 4,285,841, Barrat et al, issued Aug. 25, 1981.

Examples of surfactants also include ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. These surfactants are more fully described in U.S. Pat. No. 4,284,532, Leikhim et al, issued Aug. 18, 1981. Other surfactants include ethoxylated alcohols having an average of from about 10 to abut 15 carbon atoms in the alcohol and an average degree of ethoxylation of from about 6 to about 12 moles of ethylene oxide per mole of alcohol. Mixtures of anionic and nonionic surfactants are especially useful.

Other conventional useful surfactants are listed in standard texts, including polyhydroxy fatty acid amides, alkyl glucosides, polyalkyl glucosides, $C_{12}$–$C_{18}$ betaines and sulfobetaines (sultaines). Examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing.

Cationic Surfactants

One class of useful cationic surfactants are the mono alkyl quaternary ammonium surfactants although any cationic surfactant useful in detergent compositions are suitable for use herein.

The cationic surfactants which can be used herein include quaternary ammonium surfactants of the formula:

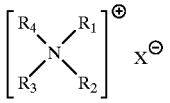

wherein $R_1$ and $R_2$ are individually selected from the group consisting of $C_1$–$C_4$ alkyl, $C_1$–$C_4$ hydroxy alkyl, benzyl, and —$(C_2H_4O)_xH$ where x has a value from about 2 to about 5; X is an anion; and (1) $R_3$ and $R_4$ are each a $C_6$–$C_{14}$ alkyl or (2) $R_3$ is a $C_6$–$C_{18}$ alkyl selected from the group consisting of $C_1$–$C_{10}$ alkyl, $C_1$–$C_{10}$ hydroxyalkyl, benzyl, and —$(C_2H_4O)_xH$ where x has a value from 2 to 5.

Other useful quaternary ammonium surfactants are the chloride, bromide, and methylsulfate salts. Examples of desirable mono-long chain alkyl quaternary ammonium surfactants are those wherein $R_1$, $R_2$, and $R_4$ are each methyl and $R_3$ is a $C_8$–$C_{16}$ alkyl; or wherein $R_3$ is $C_8$–$C_{18}$ alkyl and $R_1$, $R_2$, and $R_4$ are selected from methyl and hydroxyalkyl moieties. Lauryl trimethyl ammonium chloride, myristyl trimethyl ammonium chloride, palmityl trimethyl ammonium chloride, coconut trimethylammonium chloride, coconut trimethylammonium methylsulfate, coconut dimethyl-monohydroxy-ethylammonium chloride, coconut dimethyl-monohydroxyethylammonium methylsulfate, steryl dimethyl-monohydroxyethylammonium chloride, steryl dimethyl-monohydroxyethylammonium methylsulfate, di-$C_{12}$–$C_{14}$ alkyl dimethyl ammonium chloride, and mixtures thereof are also desirable. ADOGEN 412™, a lauryl trimethyl ammonium chloride commercially available from Witco, is also desirable. Other desirable surfactants are lauryl trimethyl ammonium chloride and myristyl trimethyl ammonium chloride.

Another group of suitable cationic surfactants are the alkanol amidal quaternary surfactants of the formula:

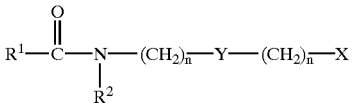

wherein $R^1$ can be $C_{10-18}$ alkyl or a substituted or unsubstituted phenyl: $R^2$ can be a $C_{1-4}$ alkyl, H, or $(EO)_y$, wherein y is from about 1 to about 5; Y is O or —$N(R^3)(R^4)$: $R^3$ can be H, $C_{1-4}$ alkyl, or $(EO)_y$, wherein y is from about 1 to about 5; $R^4$, if present, can be $C_{1-4}$ alkyl or $(EO)_y$, wherein y is from about 1 to about 5; each n is independently selected from about 1 to about 6, preferably from about 2 to about 4; X is hydroxyl or —$N(R^5)(R^6)(R^7)$, wherein $R^5$, $R^6$, $R^7$ are independently selected from $C_{1-4}$ alkyl, H, or $(EO)_y$, wherein y is from about 1 to about 5.

Amine Oxide Surfactants

The laundry detergent compositions herein also contain amine oxide surfactants of the formula:

$$R^1(EO)_x(PO)_y(BO)_zN(O)(CH_2R')_2.qH_2O \quad (I)$$

In general, it can be seen that the structure (I) provides one long-chain moiety $R^1(EO)_x(PO)_y(BO)_z$ and two short chain moieties, $CH_2R'$. R' is preferably selected from hydrogen, methyl and $-CH_2OH$. In general $R^1$ is a primary or branched hydrocarbyl moiety which can be saturated or unsaturated, preferably, $R^1$ is a primary alkyl moiety. When x+y+z=0, $R^1$ is a hydrocarbyl moiety having chainlength of from about 8 to about 18. When x+y+z is different from 0. $R^1$ may be somewhat longer, having a chainlength in the range $C_{12}$–$C_{24}$. The general formula also encompasses amine oxides wherein x+y+z=0, $R^1$=$C_8$–$C_{18}$, R' is H and q is 0–2, preferably 2. These amine oxides are illustrated by $C_{12-14}$ alkyldimethyl amine oxide, hexadecyl dimethylamine oxide, octadecylamine oxide and their hydrates, especially the dihydrates as disclosed in U.S. Pat. Nos. 5,075,501 and 5,071,594, incorporated herein by reference.

The invention also encompasses amine oxides wherein x+y+z is different from zero, specifically x+y+z is from about 1 to about 10, $R^1$ is a primary alkyl group containing 8 to about 24 carbons, preferably from about 12 to about 16 carbon atoms; in these embodiments y+z is preferably 0 and x is preferably from about 1 to about 6, more preferably from about 2 to about 4; EO represents ethyleneoxy; PO represents propyleneoxy; and BO represents butyleneoxy. Such amine oxides can be prepared by conventional synthetic methods, e.g., by the reaction of alkylethoxysulfates with dimethylamine followed by oxidation of the ethoxylated amine with hydrogen peroxide.

Desirable amine oxides herein are solids at ambient temperature, more preferably they have melting-points in the range 30° C. to 90° C. Amine oxides suitable for use herein are made commercially by a number of suppliers, including Akzo Chemie, Ethyl Corp., and Procter & Gamble. See McCutcheon's compilation and Kirk-Othmer review article for alternate amine oxide manufacturers. Other desirable commercially available amine oxides are the solid, dihydrate ADMOX 16 and ADMOX 18, ADMOX 12 and especially ADMOX 14 from Ethyl Corp.

Other embodiments include dodecyldimethylamine oxide dihydrate, hexadecyldimethylamine oxide dihydrate, octadecyldimethylamine oxide dihydrate, hexadecyltris (ethyleneoxy)dimethyl-amine oxide, tetradecyldimethylamine oxide dihydrate, and mixtures thereof. Whereas in certain embodiments R' is H, there is some latitude with respect to having R' slightly larger than H. Alternate embodiments include wherein R' is $CH_2OH$, such as hexadecylbis (2-hydroxyethyl)amine oxide, tallowbis(2-hydroxyethyl) amine oxide, stearylbis(2-hydroxyethyl)amine oxide and oleylbis(2-hydroxyethyl)amine oxide.

Enzymes

Enzymes can be included in the formulations herein for a wide variety of fabric laundering purposes, including removal of protein-based, carbohydrate-based, or triglyceride-based stains, for example, and for fabric restoration. The enzymes to be incorporated include proteases, amylases, lipases, and cellulases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01% to 1% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered tradename ESPERASE. The preparation of this enzyme and analogous enzymes is described in British Patent Specification No. 1,243,784 of Novo. Proteolytic enzymes suitable for removing protein-based stains that are commercially available include those sold under the trade names ALCALASE and SAVINASE by Novo Industries A/S (Denmark) and MAXATASE by International Bio-Synthetics, Inc. (The Netherlands). Other proteases include Protease A (see European Patent Application 130, 756, published Jan. 9, 1985) and Protease B (see European Patent Application Serial No. 87303761.8, filed Apr. 28, 1987, now EP 251446 and European Patent Application 130,756, Bott et al, published Jan. 9, 1985).

Amylases include, for example α-amylases described in British Patent Specification No. 1,296,839 (Novo), RAPIDASE, International Bio-Synthetics, Inc. and TERMAMYL, Novo Industries.

The cellulase usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from *Humicola insolens* and Humicola strain DSM1800 or a cellulase 212-producing fungus belonging to the genus Aeromonas, and cellulase extracted from the hepatopancreas of a marine mollusk (*Dolabella Auricula Solander*). Suitable cellulases are also disclosed in GB-A-2.075.028; GB-A-2.095.275 and DE-OS-2.247.832. CAREZYME (Novo) is especially useful.

Suitable lipase enzymes for detergent usage include those produced by microorganisms of the Pseudomonas group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum*, e.g. *Chromobacter viscosum* var. *lipolyticum* NRRLB 3673, commercially available from Toyo Jozo Co., Tagata, Japan; and further *Chromobacter viscosum* lipases from U.S. Biochemical Corp., U.S.A. and Diosynth Co., The Netherlands, and lipases ex *Pseudomonas gladioli*. The LIPOLASE enzyme derived from *Humicola lanuginosa* and commercially available from Novo (see also EPO 341,947) is a preferred lipase for use herein.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat.

No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described for example, in U.S. Pat. No. 3,519,570.

The enzymes employed herein may be stabilized by the presence of water-soluble sources of calcium and/or magnesium ions in the finished compositions which provide such ions to the enzymes. (Calcium ions are generally somewhat more effective than magnesium ions and are preferred herein if only one type of cation is being used.) Additional stability can be provided by the presence of various other art-disclosed stabilizers, especially borate species. See Severson, U.S. Pat. No. 4,537,706. Typical detergents, especially liquids, will comprise from about 1 to about 30, preferably from about 2 to about 20, more preferably from about 5 to about 15, and most preferably from about 8 to about 12, millimoles of calcium ion per liter of finished composition. This can vary somewhat, depending on the amount of enzyme present and its response to the calcium or magnesium ions. The level of calcium or magnesium ions should be selected so that there is always some minimum level available for the enzyme, after allowing for complexation with builders, fatty acids, etc., in the composition. Any water-soluble calcium or magnesium salt can be used as the source of calcium or magnesium ions, including, but not limited to, calcium chloride, calcium sulfate, calcium malate, calcium maleate, calcium hydroxide, calcium formate, and calcium acetate, and the corresponding magnesium salts. A small amount of calcium ion, generally from about 0.05 to about 0.4 millimoles per liter, is often also present in the composition due to calcium in the enzyme slurry and formula water. In solid detergent compositions the formulation may include a sufficient quantity of a water-soluble calcium ion source to provide such amounts in the laundry liquor. In the alternative, natural water hardness may suffice.

It is to be understood that the foregoing levels of calcium and/or magnesium ions are sufficient to provide enzyme stability. More calcium and/or magnesium ions can be added to the compositions to provide an additional measure of grease removal performance. Accordingly, as a general proposition the compositions herein will typically comprise from about 0.05% to about 2% by weight of a water-soluble source of calcium or magnesium ions, or both. The amount can vary, of course, with the amount and type of enzyme employed in the composition.

The laundry detergent compositions herein may also optionally, but preferably, contain various additional stabilizers, especially borate-type stabilizers. Typically, such stabilizers will be used at levels in the compositions from about 0.25% to about 10%, preferably from about 0.5% to about 5%, more preferably from about 0.75% to about 4%, by weight of boric acid or other borate compound capable of forming boric acid in the composition (calculated on the basis of boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

Polymeric Soil Release Agent

Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

Examples of polymeric soil release agents useful herein include U.S. Pat. No. 4,721,580, issued Jan. 26, 1988 to Gosselink; U.S. Pat. No. 4,000,093, issued Dec. 28, 1976 to Nicol, et al.; European Patent Application 0 219 048, published Apr. 22, 1987 by Kud, et al.; U.S. Pat. No. 4,702,857, issued Oct. 27, 1987 to Gosselink; U.S. Pat. No. 4,968,451, issued Nov. 6, 1990 to J. J. Scheibel. Commercially available soil release agents include the SOKALAN type of material, e.g., SOKALAN HP-22, available from BASF (West Germany). Also see U.S. Pat. No. 3,959,230 to Hays, issued May 25, 1976 and U.S. Pat. No. 3,893,929 to Basadur issued Jul. 8, 1975. Examples of this polymer include the commercially available material ZELCON 5126 (from Dupont) and MILEASE T (from ICI). Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink. Preferred polymeric soil release agents also include the soil release agents of U.S. Pat. No. 4,877,896, issued Oct. 31, 1989 to Maldonado et al.

If utilized, soil release agents will generally comprise from about 0.01% to about 10.0%, by weight, of the detergent compositions herein, typically from about 0.1 % to about 5%, preferably from about 0.2% to about 3.0%.

Clay Soil Removal/Anti-redeposition Agents

The laundry detergent compositions of the present invention can also optionally contain water-soluble ethoxylated amines having clay soil removal and antiredeposition properties. Liquid detergent compositions typically contain about 0.01% to about 5%.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal-antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. Another type of preferred antiredeposition agent includes the carboxy methyl cellulose (CMC) materials. These materials are well known in the art.

Polymeric Dispersing Agents

Polymeric dispersing agents can advantageously be utilized at levels from about 0.1% to about 7%, by weight, in the compositions herein, especially in the presence of zeolite and/or layered silicate builders. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release peptization, and anti-redeposition.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein or monomeric segments, containing no carboxylate radicals such as vinylmethyl ether, 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Brightener

Any optical brighteners or other brightening or whitening agents known in the art can be incorporated at levels typically from about 0.05% to about 1.2%, by weight, into the detergent compositions herein. Commercial optical brighteners which may be useful in the present invention can be classified into subgroups, which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM: available from Ciba-Geigy; Artic White CC and Artic White CWD, available from Hilton-Davis, located in Italy; the 2-(4-stryl-phenyl)-2H-napthol[1,2-d]triazoles; 4,4'-bis-(1,2,3-triazol-2-yl)-stilbenes; 4,4'-bis(stryl)bisphenyls; and the aminocoumarins. Specific examples of these brighteners include 4-methyl-7-diethyl-amino coumarin; 1,2-bis(-venzimidazol-2-yl)ethylene; 1,3-diphenyl-phrazolines; 2,5-bis(benzoxazol-2-yl)thiophene; 2-stryl-napth-[1,2-d]oxazole; and 2-(stilbene-4-yl)-2H-naphtho-[1,2-d]triazole. See also U.S. Pat. No. 3,646,015, issued Feb. 29, 1972 to Hamilton. Anionic brighteners are preferred herein.

Suds Suppressors

Compounds for reducing or suppressing the formation of suds can be incorporated into the compositions of the present invention. Suds suppression can be of particular importance in the so-called "high concentration cleaning process" as described in U.S. Pat. Nos. 4,489,455 and 4,489,574 and in front-loading European-style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The laundry detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., K, Na, and Li) phosphates and phosphate esters. The hydrocarbons such as paraffin and haloparaffin can be utilized in liquid form. The liquid hydrocarbons will be liquid at room temperature and atmospheric pressure, and will have a pour point in the range of about −40° C. and about 50° C., and a minimum boiling point not less than about 110° C. (atmospheric pressure). It is also known to utilize waxy hydrocarbons, preferably having a melting point below about 100° C. The hydrocarbons constitute a preferred category of suds suppressor for detergent compositions. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin," as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779, issued May 5, 1981 to Gandolfo et al and European Patent Application No. 89307851.9, now EP354016 published Feb. 7, 1990, by Starch, M. S.

Other silicone suds suppressors are disclosed in U.S. Pat. No. 3,455,839 which relates to compositions and processes for defoaming aqueous solutions by incorporating therein small amounts of polydimethylsiloxane fluids.

Mixtures of silicone and silanated silica are described, for instance, in German Patent Application DOS 2,124,526.

In the preferred silicone suds suppressor used herein, the solvent for a continuous phase is made up of certain polyethylene glycols or polyethylene-polypropylene glycol copolymers or mixtures thereof (preferred), or polypropylene glycol. The primary silicone suds suppressor is branched/crosslinked and preferably not linear.

To illustrate this point further, typical liquid laundry detergent compositions with controlled suds will optionally comprise from about 0.001 to about 1, preferably from about 0.01 to about 0.7, most preferably from about 0.05 to about 0.5, weight % of said silicone suds suppressor, which comprises (1) a nonaqueous emulsion of a primary antifoam agent which is a mixture of (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates; (2) at least one nonionic silicone surfactant; and (3) polyethylene glycol or a copolymer of polyethylene-polypropylene glycol having a solubility in water at room temperature of more than about 2 weight %; and without polypropylene glycol. See also U.S. Pat. No. 4,978,471, Starch, issued Dec. 18, 1990, and U.S. Pat. No. 4,983,316, Starch, issued Jan. 8, 1991, U.S. Pat. No. 5,288,431, Huber et al., issued Feb. 22, 1994, and U.S. Pat. Nos. 4,639,489 and 4,749,740, Aizawa et al at column 1, line 46 through column 4, line 35.

The silicone suds suppressor herein preferably comprises polyethylene glycol and a copolymer of polyethylene glycol/polypropylene glycol, all having an average molecular weight of less than about 1,000, preferably between about 100 and 800. The polyethylene glycol and polyethylene/polypropylene copolymers herein have a solubility in water at room temperature of more than about 2 weight %, preferably more than about 5 weight %.

The preferred solvent herein is polyethylene glycol having an average molecular weight of less than about 1,000, more preferably between about 100 and 800, most preferably between 200 and 400, and a copolymer of polyethylene glycol/polypropylene glycol, preferably PPG 200/PEG 300. Preferred is a weight ratio of between about 1:1 and 1:10, most preferably between 1:3 and 1:6, of polyethylene glycol:copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide, like PLURONIC L101.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol+silicone at a weight ratio of 1:5 to 5:1.

For any detergent compositions to be used in automatic laundry washing machines, suds should not form to the extent that they overflow the washing machine. Suds suppressors, when utilized, are preferably present in a "suds suppressing amount. By "suds suppressing amount" is meant that the formulator of the composition can select an amount of this suds controlling agent that will sufficiently control the suds to result in a low-sudsing laundry detergent for use in automatic laundry washing machines.

The laundry detergent compositions herein will generally comprise from 0% to about 5% of suds suppressor. When utilized as suds suppressors, monocarboxylic fatty acids, and salts therein, will be present typically in amounts up to about 5%, by weight, of the detergent composition. Silicone suds suppressors are typically utilized in amounts up to about 2.0%, by weight, of the detergent composition, although higher amounts may be used. This upper limit is practical in nature, due primarily to concern with keeping costs minimized and effectiveness of lower amounts for effectively controlling sudsing. Preferably from about 0.01% to about 1% of silicone suds suppressor is used, more preferably from about 0.25% to about 0.5%. As used herein, these weight percentage values include any silica that may be utilized in combination with polyorganosiloxane, as well as any adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions.

Dye Transfer Inhibiting Agents

The laundry detergent compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: R—$A_x$—P; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

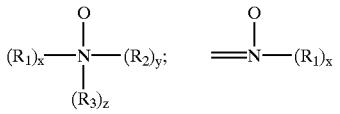

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the detergent compositions herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis*, Vol 113. "Modem Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The laundry detergent compositions also may employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

The laundry detergent compositions herein may also optionally contain from about 0.005% to 5% by weight of certain types of hydrophilic optical brighteners which also provide a dye transfer inhibition action. If used, the compositions herein will preferably comprise from about 0.01% to 1% by weight of such optical brighteners.

The hydrophilic optical brighteners useful in the present invention are those having the structural formula:

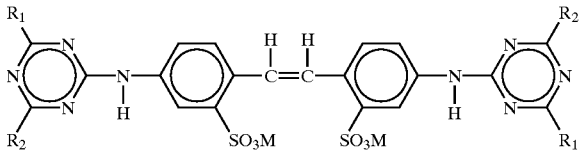

wherein $R^1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4'-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal SBM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

The specific optical brightener species selected for use in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA- GX, Tinopal 5BM-GX and/or Tinopal AMS-GX) provides significantly better dye transfer inhibition in aqueous wash solutions than does either of these two detergent composition components when used alone. Without being bound by theory, it is believed that such brighteners work this way because they have high affinity for fabrics in the wash solution and therefore deposit relatively quick on these fabrics. The extent to which brighteners deposit on fabrics in the wash solution can be defined by a parameter called the "exhaustion coefficient". The exhaustion coefficient is in general as the ratio of a) the brightener material deposited on fabric to b) the initial brightener concentration in the wash liquor. Brighteners with relatively high exhaustion coefficients are the most suitable for inhibiting dye transfer in the context of the present invention.

Of course, it will be appreciated that other, conventional optical brightener types of compounds can optionally be used in the present compositions to provide conventional fabric "brightness" benefits, rather than a true dye transfer inhibiting effect. Such usage is conventional and well-known to detergent formulations.

Bleaching Compounds—Bleaching Agents and Bleach Activators

The laundry detergent compositions herein may optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetrahydrate) and percarbonate bleaches can be used herein.

Another category of bleaching agent that can be used without restriction encompasses percarboxylic acid bleaching agents and salts thereof. Suitable examples of this class of agents include magnesium monoperoxyphthalate hexahydrate the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application Ser. No. 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L$$

or $$R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamidocaproyl) oxybenzenesulfonate, (6-nonanamidocaproyl) oxybenzenesul-fonate, (6-decanamidocaproyl) oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. Still another class of preferred bleach activators includes the acyl lactam activators, especially acyl caprolactams and acyl valerolactams. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. Nos. 5,246,621, 5,244,594; 5,194,416; 5,114,606; and European Pat. App. Pub. Nos. 549,271A1, 549,272A1, 544,440A2, and 544,490A1. As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm, of the catalyst species in the laundry liquor.

Anti-Static Agents

The laundry detergent compositions can also comprise anti-static agents as illustrated in U.S. Pat. No. 4,861,502. Preferred examples of anti-static agents include alkyl amine-anionic surfactant ion pairs, such as distearyl amine-cumene sulfonate ion pairs. If present, anti-static agents are present in an amount of from about 0.5% to about 20%, preferably from about 1% to about 10%, more preferably from about 1% to about 5%, by weight of the detergent composition.

In the following Example A, an embodiment of the present invention of a chelant agglomerate is exemplified:

| Ingredient | Wt % |
|---|---|
| Zeolite | 85.00 |
| DTPA | 15.00 |
| Total | 100.0% |

Accordingly, having thus described the invention in detail, it will be obvious to those skilled in the art that various changes may be made without departing from the scope of the invention and the invention is not to be considered limited to what is described in the specification.

What is claimed is:

1. A process for preparation of a chelant composition by a non-spray-drying process, comprising the steps of:

a) admixing a transition metal chelant and an inorganic compound to form a mixture;

b) agglomerating said mixture in an aqueous medium to form a chelant agglomerate; and c) drying said chelant agglomerate wherein the inorganic compound is selected from the group consisting of sulfates, carbonates, silicates, aluminosilicates and mixtures thereof; and wherein the transition metal chelant is selected from the group consisting of diethylenetriaminepentaacetates; ethylenediamine disuccinate; and mixtures thereof; and wherein the chelant agglomerate resulting from step c) consists of said transition metal chelant and said inorganic compound.

2. The process according to claim 1, wherein said transition metal chelant is selected from the group consisting of sodium dithylenetriaminepentaacetate, ethylenediamine disuccinate, and mixtures thereof.

3. The process according to claim 1, wherein said transition metal chelant is sodium diethylenetriaminepentaacetate.

4. The process according to claim 1, wherein said inorganic compound is an aluminosilicate ion exchange material of the formula, $M_{m/n}[(AlO_2)_m(SiO_2)_y].xH_2O$ where n is the valence of the cation M, x is the number of water molecules per unit cell, m and y are the total number of tetrahedra per unit cell, and y/m is 1 to 100, and wherein M is selected from the group consisting of sodium, potassium, magnesium, and calcium.

5. The process according to claim 1, wherein said inorganic compound is zeolite.

6. The process according to claim 1, wherein said step of admixing includes mixing and granulating said transition metal chelant and said inorganic compound in one or more of a high-speed mixer and granulator.

7. The process according to claim 1, wherein said step of agglomerating includes forming a chelant-inorganic compound pre-mix with water.

8. The process according to claim 1 wherein said transition metal chelant and said inorganic compound are admixed in a weight ratio in a range of from about 10:90 to about 80:20 respectively.

9. The process according to claim 1 wherein said mixture and said aqueous medium are pre-mixed before agglomerating, in a weight ratio in a range of from about 10:90 to about 80:20 respectively.

10. A process for improving one or more of storage stability, flowability and scoopability of a laundry detergent composition, comprising the steps of:

(a) providing a chelant composition prepared by a non-spray-drying process, comprising the steps of:

(i) admixing a transition metal chelant and an inorganic compound to form a mixture;

(ii) agglomerating said mixture in an aqueous medium to form a chelant agglomerate; and (iii) drying said chelant agglomerate;

wherein the transition metal chelant is selected from the group consisting of diethylenetriaminepentaacetates, ethylenediamine disuccinate; and mixtures thereof; and wherein the chelant agglomerate resulting from step iii) consists of said transition metal chelant and said inorganic compound; and (b) incorporating said chelant composition into a particulate laundry detergent material in a weight ratio in a range of from about 0.05:99.95 to about 2:98, chelant composition to particulate laundry detergent material.

11. The process according to claim 10, wherein said laundry detergent composition has at least increased scoopability.

12. The process according to claim 10, wherein said transition metal chelant is sodium diethylenetriaminepentaacetate.

13. The process according to claim 10, wherein said inorganic compound is selected from the group consisting of sulfates, carbonates, silicates, aluminosilicates and mixtures thereof.

14. The process according to claim 10, wherein said inorganic compound is an aluminosilicate material of the formula, $M_{m/n}[(AlO_2)_m(SiO_2)_y].xH_2O$ where n is the valence of the cation M, x is the number of water molecules per unit cell, m and y are the total number of tetrahedra per unit cell, and y/m is 1 to 100, and wherein M is selected from the group consisting of sodium, potassium, magnesium, and calcium.

15. The process according to claim 14, wherein said inorganic compound is zeolite.

16. The process according to claim 10 wherein said transition metal chelant and said inorganic compound are admixed in a weight ratio in a range of from about 10:90 to about 80:20 respectively.

17. The process according to claim 10 wherein said mixture and said aqueous medium are premixed before agglomerating, in a weight ratio in a range of from about 10:90 to about 80:20 respectively.

18. A chelant agglomerate useful as an ad-mix in a particulate laundry detergent, the chelant agglomerate consisting of:

a transition metal chelant selected from the group consisting of diethylenetriaminepentaacetates; ethylenediamine disuccinate; and mixtures thereof;

an inorganic compound selected from the group consisting of sulfates, carbonates, silicates, aluminosilicates and mixtures thereof; and water;

said chelant agglomerate being formed by admixing said transition metal chelant and said inorganic compound to form a mixture, agglomerating said mixture in said water to form said chelant agglomerate and drying the chelant agglomerate.

19. The chelant composition according to claim 18, wherein said transition metal chelant is sodium diethylenetriaminepentaacetate.

20. The chelant composition according to claim 18, wherein said inorganic compound is an aluminosilicate material of the formula, $M_{m/n}[(AlO_2)_m(SiO_2)_y].xH_2O$ where n is the valence of the cation M, x is the number of water molecules per unit cell, m and y are the total number of tetrahedra per unit cell, and y/m is 1 to 100, and wherein M is selected from the group consisting of sodium, potassium, magnesium, and calcium.

21. The chelant composition according to claim 20, wherein said aluminosilicate material is zeolite.

22. The chelant composition according to claim 18, wherein said transition metal chelant and said inorganic compound are present in a weight ratio in a range of from about 10:90 to about 80:20 respectively.

* * * * *